United States Patent [19]

Saringer

[11] Patent Number: 4,930,497

[45] Date of Patent: Jun. 5, 1990

[54] APPARATUS FOR IMPARTING CONTINUOUS PASSIVE MOTION TO A LOWER LIMB

[75] Inventor: John H. Saringer, Markham, Canada

[73] Assignee: Toronto Medical Corp., Scarborough, Canada

[21] Appl. No.: 300,040

[22] Filed: Jan. 23, 1989

[51] Int. Cl.[5] ..... A61H 1/02

[52] U.S. Cl. ..... 128/25 R

[58] Field of Search ..... 128/25 R, 25 B, 87 R, 128/88, 80 G, 26, 80 C, 80 F; 272/96; 623/39, 59

[56] References Cited

U.S. PATENT DOCUMENTS

| | | | |
|---|---|---|---|
| 4,337,764 | 7/1982 | Lerman | 128/80 F |
| 4,492,222 | 1/1985 | Hajianpour | 128/25 R |
| 4,509,509 | 4/1985 | Bouvèt et al. | 128/25 R |
| 4,538,595 | 9/1985 | Hajianpour | 128/25 R |
| 4,549,534 | 10/1985 | Zagorski et al. | 128/25 R |
| 4,554,913 | 11/1985 | Womack et al. | 128/80 C |
| 4,558,692 | 12/1985 | Greiner | 128/25 R |
| 4,576,148 | 3/1986 | Koerner et al. | 128/26 |
| 4,620,532 | 11/1986 | Houseworth | 128/80 F X |
| 4,665,899 | 5/1987 | Farris et al. | 128/25 R |
| 4,671,257 | 6/1987 | Kaiser et al. | 128/25 R |

*Primary Examiner*—Richard J. Apley
*Assistant Examiner*—Howard Flaxman
*Attorney, Agent, or Firm*—Wolf, Greenfield & Sacks

[57] ABSTRACT

An apparatus is provided for imparting passive motion exercise to a lower limb of a patient. The apparatus includes a base and a thigh support member having a pair of elongated parallel spaced-apart brace members pivoted at their respective first ends to the base. The other ends of the thigh support brace members terminate at a mechanical hinge. A lower leg support includes a pair of parallel spaced-apart brace members extending from the mechanical hinge. The base is provided with a slide surface for supporting the other ends of the brace members of the lower leg support while allowing for extension and retraction thereof. The mechanical hinge includes at least a shaft fixed to the thigh support with the brace members lower leg support journaled to the shaft. An electric motor is mounted to the lower leg support to drive the shaft such that the angular movement is provided between the thigh support and the lower leg support, whereby the angular speed is maintained constant when motor speed is constant.

8 Claims, 3 Drawing Sheets

APPARATUS FOR IMPARTING CONTINUOUS PASSIVE MOTION TO A LOWER LIMB

BACKGROUND OF THE INVENTION

1. Field of the Invention

The present invention relates to rehabilitation devices, and in particular, to an apparatus for imparting continuous passive motion to a lower limb of the human anatomy.

2. Description of the Prior Art

The prior art is replete with examples of devices for passively mobilizing the joint of a person's limbs U.S. Pat. No. 4,549,534, issued to Zagorski et al on Oct. 29, 1985, describes the background and benefits of such devices. Other examples of such apparatuses are described in U.S. Pat. Nos. 4,492,222, Hajianpour, Jan. 8, 1985; 4,509,509, Bouvet et al, Apr. 9, 1985; 4,558,692, Greiner, Dec. 17, 1985; and 4,665,899, Farris et al, May 19, 1987. All of these patents, which represent the prior art, have in common a structure which includes a base, a thigh support first member hinged to the base at one end, and a lower leg support second member hinged to the first member at the other end thereof. A motor means is generally connected to the other end of the second member and the base such that the first and second members can be folded upwardly and extended horizontally relative to the base. In normal use, a patient is in a reclined position with a hip joint adjacent the hinge between the base and the thigh support first member. The patient's respective leg extends over the first and second support members. As the motor is driven, the first and second members fold upwardly and then extend longitudinally, thus passively exercising the supported leg. The cycle is then repeated.

Since the motor is operatively engaged to the other end of the second member, the first and second members fold and extend as a result of a reciprocating push-pull action applied at the other end of the second member. The motor speed can usually be varied, but once set for a given cycle, the speed is generally constant. However, the hinge between the first and second members will be in a continual acceleration-deceleration cycle, depending on the angle between the members, as a result of the constant speed of the motor at one end of the linkage. Since the patient's knee is being flexed at this hinge location, it will be subjected to these fluctuations in speed.

SUMMARY OF THE INvENTION

It is an aim of the present invention to provide an improved apparatus for imparting passive motion to the lower limb, including providing a constant hinging speed between the first and second members when driven at a constant motor speed. In other words, the angle between the first and second members will open and close at a constant speed directly proportional to motor speed.

It is a further aim of the present invention to provide such a joint mobilizer with a device adjusting the reciprocating cycle of the motor and thus the pitch of hinging movement between the first and second members.

In a construction according to the present invention, there is provided a continuous passive motion exercise apparatus for exercising a limb of a patient comprising a first support member including an elongated rigid member adapted to be secured to the proximal element of the limb of the patient and a including at least one end adapted to coincide with the joint between the proximal and distal limb portions. The apparatus also includes a second support including a rigid elongated member adapted to be secured to the distal portion of the limb to be exercised. The second support includes an end hinged to the one end of the first member at a mechanical hinge approximately coinciding with the joint of the limb. Motor means are provided at the mechanical hinge for positively driving the hinge to cause folding and extension of the first and second supports at a constant angular speed.

In another aspect of the present invention, a motor reverse, adjustable control means is provided on the apparatus for determining the pitch of the reciprocal angular movement of the first and second members including a pair of spaced-apart gates mounted adjacent the mechanical hinge on one of the first and second supports and means for adjusting the relative distance between the gates. On the other of the first and second members is a gate reading means adapted to be actuated when aligned with one of the gates such as to reverse the motor means.

In a more specific embodiment of the present invention, there is provided a base and a thigh support member including a pair of elongated parallel spaced-apart brace elements pivoted at their respective first ends to the base. The other ends of the thigh support brace elements terminate at a mechanical hinge. A lower leg support including a pair of parallel spaced-apart brace elements extends from the mechanical hinge, the base being provided with means for supporting the other ends of the brace elements of the lower leg support while allowing for extension and retraction of the other ends of the braces. The mechanical hinge includes at least a shaft fixed to the brace elements of one of the thigh support and lower leg support with the brace members of the other of the thigh support and lower leg support journaled to the at least one shaft. The motor means is mounted to the other of the thigh support and lower leg support to drive the shaft such that angular movement is provided between the thigh support and lower leg support. The angular speed is, therefore, constant.

BRIEF DESCRIPTION OF THE DRAWINGS

The invention will now be described in detail having reference to the accompanying drawings in which.

DESCRIPTION OF THE PREFERRED EMBODIMENTS

Figure 1:
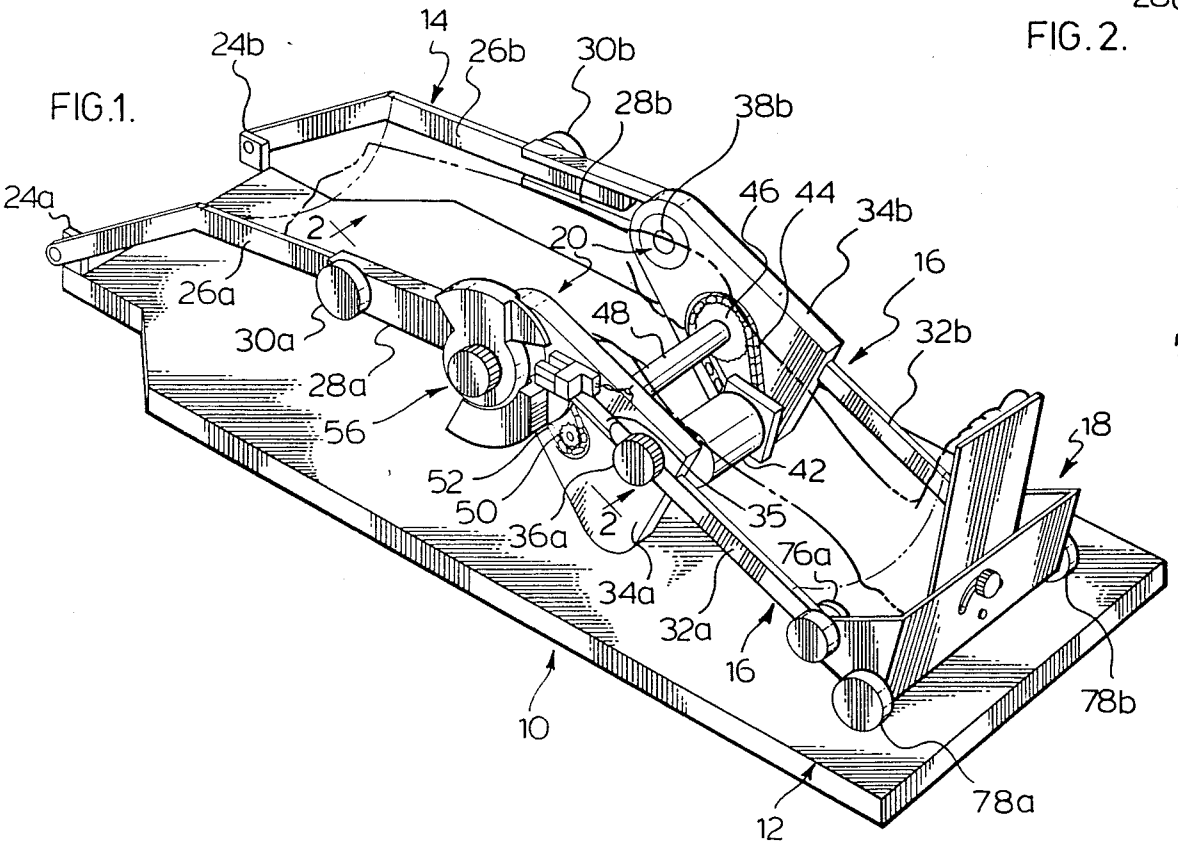
FIG. 1 is a perspective view of an apparatus in accordance with the present invention.

Referring now to the drawings, there is shown in FIG. 1 an apparatus for imparting continuous passive motion to the leg of a person which includes a base 12, a thigh support 14, and a lower leg support 16 hinged to the thigh support at a mechanical hinge 20. The other end of the lower leg support 16 is provided with a foot support 18.

The thigh support 14 is pivotally mounted to an angle bar 22 at one edge of the base 12. A pair of pivot brackets 24a and 24b are provided on the angle bar 22 to which individual first thigh support brace members 26a and 26b are pivoted respectively. First thigh support brace members 26a and 26b slide in channel-shaped second thigh support members 28a and 28b respectively. Locking nuts 30a and 30b are provided for adjustably locking the first thigh support members 26a and 26b to the second thigh support members 28a and 28b, thereby providing length adjustment in order to ensure the proper fitting of the apparatus to the patient.

The lower leg support 16 includes a first lower leg support brace member 34a and 34b which in turn are hinged by respective stub shaft members 38a and 38b to the second thigh support members 38a and 38b respectively. The first lower limb support brace members 34a and 34b include channels 35 for receiving second lower limb support members 32a and 32b. Locking nuts 36a and 36b are provided for adjustably securing the respective members 32 and 34 in a length adjustment relationship in order to adjust to the length of the patient's lower leg.

A foot support 18 is mounted to the other ends of the second lower leg support members 32a and 32b and is adjustable for different angular positions by means of locking nuts 76a and 76b. The foot support 18 is also provided with idler wheels 78a and 78b to travel on a runway on the base 12.

Figure 2:
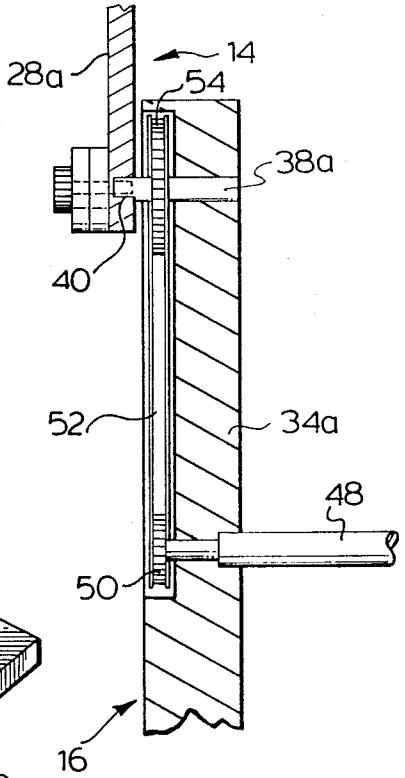
FIG. 2 is a fragmentary enlarged cross-section taken along line 2—2 of FIG. 1.
Figure 3:
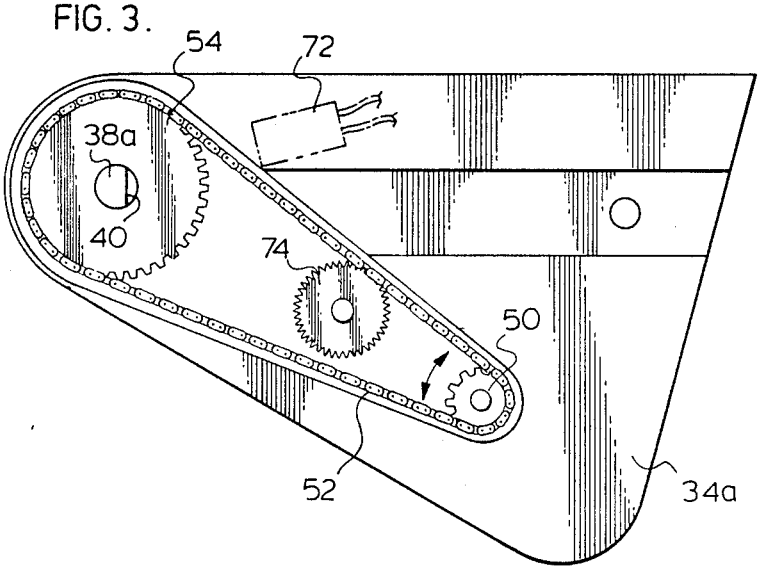
FIG. 3 is a fragmentary side elevation of the detail of FIG. 1.

An electric motor 42 is mounted to the first lower leg support member 34b and includes a sprocket (not shown) about which the chain 44 runs. The chain 44 is also engaged on the sprocket 46 which in turn is fixedly mounted to the shaft 48 which is journaled to the first lower leg support members 34a and 34b respectively. A portion of the shaft 48 projects exteriorly of the first lower leg support member 34a and mounts a sprocket 50 about which a chain 52 is entrained. As shown in FIG. 3, the chain 52 passes over sprocket 54 which is fixedly mounted to the stub shaft 38a (FIG. 2). The stub shaft 38a is journaled in the first lower leg support member 34a but is keyed to the second thigh support member 28a. The keyed portion of the shaft 38a is illustrated at 40. There is a speed reducing mechanism of ≈2000:1 between the motor and the hinge.

Thus, in operation, when the electric motor 42 is activated in one direction, it will drive the chain 44, sprocket 46, transverse shaft 48, and in turn, the sprocket 50, as shown in FIGS. 2 and 3, which will drive chain 52 and thus sprocket 54, and thus the stub shaft 38a which, because of its keyed engagement with the second thigh support member 28a, will cause the thigh support member 14 to pivot relative to the lower leg support member 16.

Figure 4:
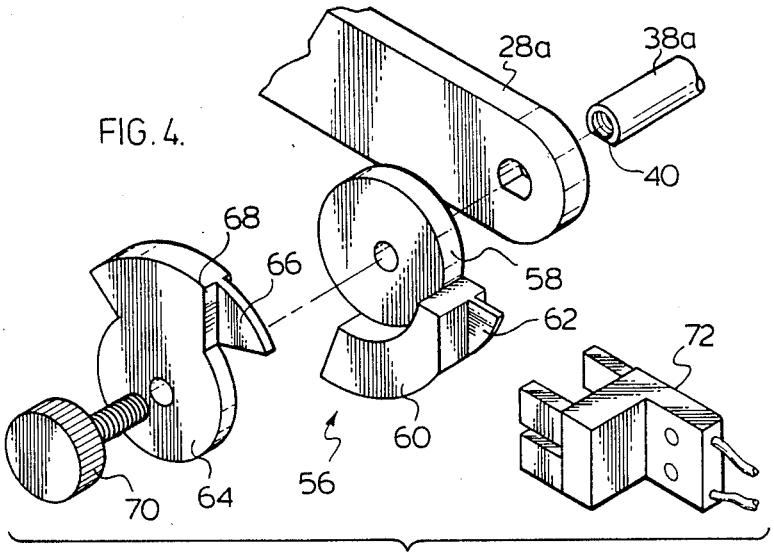
FIG. 4 is an exploded view of a further detail of the apparatus shown in FIG. 1.
Figure 6A:
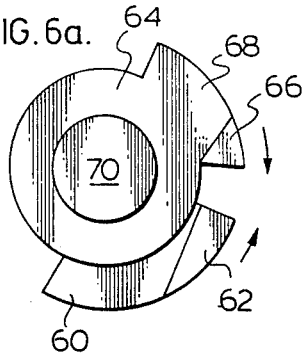
FIGS. 6*a* and 6*b* are fragmentary side elevations of a detail of FIGS. 4 and 5 showing different adjustment positions.
Figure 6B:
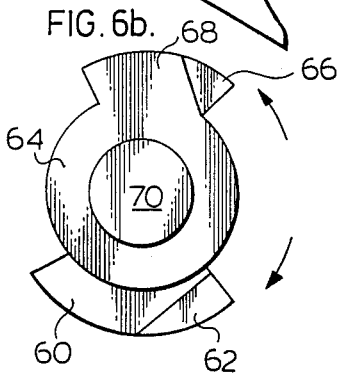

In order to provide reversal of the motor 42 and thus reverse the direction of angular movement, there is provided a motor reverse control 56. As shown in FIG. 4, the motor reverse control 56 includes a first disc 58 which includes an accurate flange 60 and a gate member 62. The disc 58 is frictionally engaged with the second thigh support member 28a so as to move in unison therewith. A second disc 64 mounting an abutment 68 and a gate 66 is mounted to be normally in a fixed relation to the disc 58. It is held in this relationship by means of a nut 70 which is threaded into the hollow portion of the stub shaft 38a. As shown in FIGS. 6a and 6b, the discs 58 and 64 can be adjusted relative to each other by releasing the nut 70. Once the discs 58 and 64 are adjusted to the proper angular distance between the gates 62 and 66 corresponding to the actual pitch of the reciprocating angular movement required, the nut 70 is secured.

An electric light reading device, 72 is provided on the first lower leg support member 34a, and thus travels with the support member 34a. The respective gates 62 and 66a, which are in the same radial plane, are mounted to pass in the slot formed within the detector or light reading device 72. When the gates 62 or 66a interrupt the light beam within the detector 72, the detector 72 sends a signal to the electric motor 42 to thus reverse the motor.

Figure 5A:
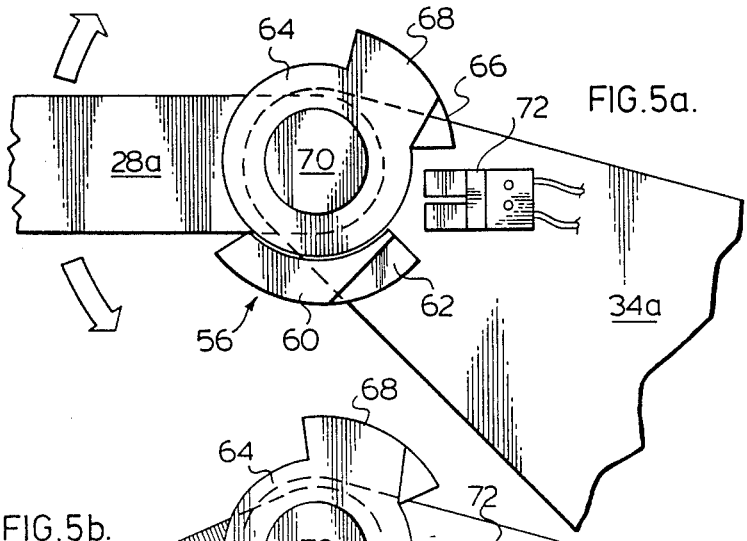
FIGS. 5*a*, 5*b*, and 5*c* are fragmentary side elevations showing the sequential positions of a detail shown in FIG. 4 when the apparatus is in operation.
Figure 5B:
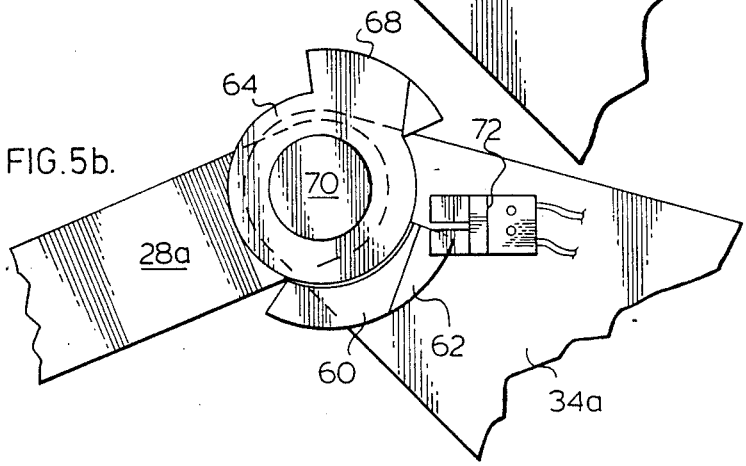
Figure 5C:
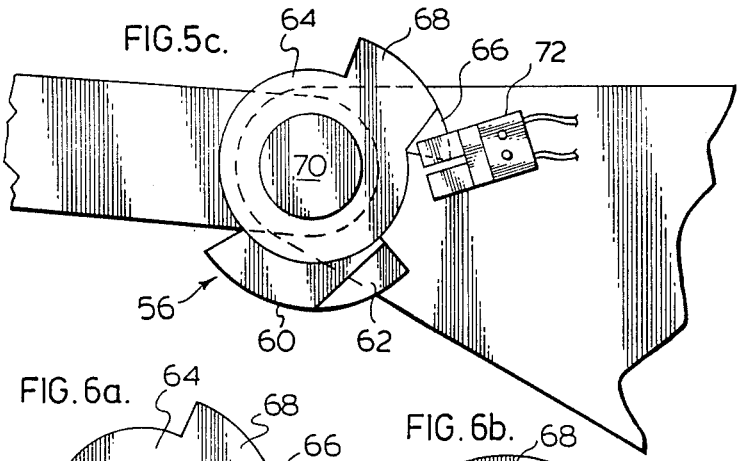

A sequential showing of the positions is shown in FIGS. 5a, 5b, and 5c.

Thus, a patient's leg may be placed on the support member such that his thigh is supported by slings shown in dotted lines on the thigh support 14, and his lower leg is supported by the slings shown in dotted lines on the lower leg support 16. The length of the thigh support 14 and lower leg support 16 are adjusted such that the knee of the patient coincides with the mechanical hinge 20. The patient's foot will rest in the foot support 18, and that can be adjusted to a comfortable angle for the patient.

As the device is activated, the motor 42, as previously discussed, causes the thigh support 14 and lower leg support 16 to fold upwardly about the mechanical hinge 20 until the detector 72 reads the gate 62. Because of the upwardly folding movement, the lower leg support 16 will cause the foot rest 18 to move inwardly towards the angle member 22 on the base 12. Such movement is allowed by means of the wheels 70a and 70b running on a runway on the top surface of the base 10. Once the detector 72 has read the gate 62, the motor 42 will reverse, thus, causing the thigh support 14 and lower leg support 16 to extend, whereby the foot support will move outwardly opposite to the angle member 22 on the wheels 78 and 78b. Because the mechanical hinge 20 is driven by motor means, i.e. motor 42, chains 44 and 52, the angular speed at the mechanical hinge will be directly related to the speed of the motor 42. As long as the motor speed is constant, the angular speed at the mechanical hinge 20 will be constant.

As previously mentioned, the pitch of the reciprocating angular movement can be adjusted by adjusting the angular distance between the gates 62 and 66.

I claim:

1. An apparatus for imparting passive motion for mobilizing a knee joint of a patient, the apparatus including a base, a thigh support member, including a pair of elongated parallel spaced-apart brace members pivoted at their respective first ends to the base, the other ends of the thigh support brace members terminating at a mechanical hinge, a calf support including a pair of parallel spaced-part brace members extending from the mechanical hinge, the base being provided with means for supporting the other ends of the brace members of the calf support while allowing for extension and retraction thereof; the mechanical hinge including a respective shaft fixed to one of the thigh support or calf support between the respective pairs of brace members with the brace members of the other of the thigh support or calf support journaled to the shafts; motor means mounted to the other of the thigh support or calf support to drive the shafts such that the angular movement is provided between the thigh support and the lower leg support, whereby the angular speed is maintained constant.

2. An apparatus for providing a continuous passive motion for mobilizing a knee joint of a patient, comprising:

a first support member including an elongated rigid member adapted to be secured to the proximal portion of the thigh of the patient, and including at least one end in the area of the knee joint between the thigh and calf, a second support including a rigid elongated member adapted to be secured to the calf of the limb to be exercised, the second support including an end hinged to the one end of the first member at a mechanical hinge in the area with the knee joint of the limb and extending to both sides of the knee, and motor means provided at the mechanical hinge for positively driving the hinge on both sides of the knee to cause folding and extension of the first and second supports such that a constant motor speed imparts a constant angular speed, the motor means including an electric motor mounted on the second support and high torque gear means associated with the electric motor and mechanical hinge for driving the hinge.

3. An apparatus as defined in claim 2, wherein the motor means includes a motor reverse adjustable control means provided on the apparatus for determining the pitch of the reciprocal angular movement of the first and second members, said control means including a pair of spaced-apart gates mounted adjacent the mechanical hinge on one of the first or second supports, and means for adjusting the relative distance between the gates, a gate reading means provided on the other of the first and second members adapted to actuate the motor means for reversing the motor means when the gate reading means reads one of the gates.

4. An apparatus as defined in claim 1, wherein the brace members of the thigh support are hingedly connected to the edge of the base, and the brace members of the calf support are connected to a foot rest which in turn has low friction means adapted to allow the foot rest to glide on the base.

5. An apparatus as defined in claim 4, wherein the low friction means are rollers provided on the foot rest adapted to engage a runway on the top of the base.

6. An apparatus as defined in claim 4, wherein the respective brace members of the thigh support and the calf support art adjustable for longitudinal linear extension whereby the length of the thigh support and the length of the calf support can be adjusted to the anatomy of the limb to be exercised.

7. An apparatus as defined in claim 1, wherein an electrical motor is provided on the calf support and the shafts are fixedly connected to the thigh support and drive means are provided between the electric motor means and the shafts for driving the shafts on either side of the joint and thus causing the thigh support to pivot about the mechanical hinge as a reaction to the drive.

8. An apparatus as defined in claim 3, wherein the gate means includes a pair of radial discs mounted on a shaft means at said mechanical hinge fixed to the first support and adjustable for adjustment of the gates and the gate reading means is mounted on the second support so as to read the gates which are moving in unison with the thigh support.

* * * * *